US007676936B2

(12) United States Patent
Ball et al.

(10) Patent No.: US 7,676,936 B2
(45) Date of Patent: Mar. 16, 2010

(54) FOOT MEASUREMENT APPARATUS

(75) Inventors: Michael E. Ball, Ellison Bay, WI (US); Jeffrey D. Bransky, Chicago, IL (US)

(73) Assignee: Woodrow Engineering Company, Sister Bay, WI (US)

( * ) Notice: Subject to any disclaimer, the term of this patent is extended or adjusted under 35 U.S.C. 154(b) by 95 days.

(21) Appl. No.: 11/941,229

(22) Filed: Nov. 16, 2007

(65) Prior Publication Data

US 2009/0126210 A1 May 21, 2009

(51) Int. Cl.
*A43D 1/02* (2006.01)
*A61B 5/107* (2006.01)

(52) U.S. Cl. ..... 33/3 B; 33/515

(58) Field of Classification Search ..... 33/3 A, 33/3 B, 3 C, 3 R, 511–512, 515, 806, 832
See application file for complete search history.

(56) References Cited

U.S. PATENT DOCUMENTS 1,356,489 A * 10/1920 Dawkins ..... 33/3 A
1,594,255 A * 7/1926 Goldsmith ..... 33/3 A
1,670,664 A * 5/1928 Jones ..... 33/3 A
2,000,257 A * 5/1935 Scholl ..... 33/3 A
2,474,466 A * 6/1949 Carling ..... 33/277
2,593,385 A * 4/1952 Digate ..... 33/3 R
2,824,372 A * 2/1958 Bottenfield ..... 33/3 A
3,148,450 A * 9/1964 Del Pesco ..... 33/3 B
3,854,212 A * 12/1974 Rose ..... 33/3 A
4,177,573 A * 12/1979 Boston, III ..... 33/277
5,339,252 A 8/1994 White et al.
5,509,212 A * 4/1996 Henricksen ..... 33/565
5,689,446 A * 11/1997 Sundman et al. ..... 33/3 A
6,003,235 A * 12/1999 Chen ..... 33/512
6,145,210 A * 11/2000 Walczynski ..... 33/458
6,226,881 B1 * 5/2001 Landauer ..... 33/515
6,251,087 B1 * 6/2001 Sandifer ..... 600/592
6,834,437 B1 12/2004 Kilgore et al.
6,954,557 B2 10/2005 Kim et al.
6,983,548 B1 1/2006 Cook et al.
7,051,452 B2 5/2006 Brooks
7,516,555 B2 * 4/2009 Sullivan ..... 33/3 R

OTHER PUBLICATIONS

Ritz Stick, 2005, homepage. <www.ritzstick.com>.
Ritz Stick, 2005, Distributors. <www.ritzstick.com/distributors>.

* cited by examiner

*Primary Examiner*—Yaritza Guadalupe-McCall
(74) *Attorney, Agent, or Firm*—Jansson Shupe & Munger Ltd.

(57) ABSTRACT

A foot measurement apparatus for measuring the dimensions of a foot. The foot measurement apparatus includes an integrally-formed unitary base having first and second sections each with proximal ends and distal ends and top and bottom surfaces. The first and second sections are connected by a living-hinge interconnection portion at their proximal ends. The foot measurement apparatus also includes a measuring scale attached to the top surfaces of the first and second sections. The foot measurement apparatus additionally includes an erectable heel-tab structure which is attached to the unitary base near the distal end of the first section. The heel-tab structure has a heel-contact portion which is pivotable between a collapsed position overlying the top surface of the first section and an erected position substantially normal to the first section. The foot measurement apparatus also includes an erectable toe-tab structure.

14 Claims, 17 Drawing Sheets

FOOT MEASUREMENT APPARATUS

FIELD OF THE INVENTION

The invention relates to a collapsible apparatus for measuring the dimensions of a foot.

BACKGROUND OF THE INVENTION

A number of problems exist with respect to foot measurement devices. These problems are well-known to those who are involved with footwear and the various sizing devices associated with footwear. Specifically, there is a need for a collapsible foot measuring device that is simple to use and can be easily shipped to a consumer for use.

In today's market numerous people purchase goods, such as footwear, through the internet or mail order catalogs. Oftentimes people are apprehensive to order footwear without first trying the item on as customary in a footwear store. Consumers fear that they will order the incorrect size and incur the hassle of returning or exchanging the item. Thus, there is a need for a collapsible foot measuring device that consumers can use in the comfort of their home which will ensure that the proper size footwear is ordered when consumers cannot first try on the item.

Various foot measuring devices have been developed. Examples of such prior art devices are those disclosed in the following United States patents: U.S. Pat. No. 7,051,452 (Brooks), U.S. Pat. No. 6,983,548 (Cook, et al.), U.S. Pat. No. 6,954,557 (Rim, et al.), U.S. Pat. No. 6,834,437 (Kilgore, et al.) and U.S. Pat. No. 5,339,252 (White, et al.).

Foot measuring devices in the prior art have certain shortcomings and disadvantages to which this invention is addressed. In particular, there is a need for a foot measuring apparatus which is sturdy and collapsible. It would be desirable that a foot measuring device be easy to use and compact so that it can be readily shipped to a consumer.

OBJECTS OF THE INVENTION

It is an object of this invention to provide a foot measuring apparatus that overcomes some of the problems and shortcomings associated with the prior art.

Another object of this invention is to provide a foot measuring apparatus that is collapsible for convenient and compact shipping to consumers.

Another object of this invention is to provide a foot measuring apparatus that is constructed in a sturdy nature so as to hold up after numerous uses.

Another object of this invention is to provide a foot measuring apparatus that is easy to use.

These and other objects of the invention will be apparent from the following descriptions and the drawings.

SUMMARY OF THE INVENTION

The invention is a foot measurement apparatus for measuring the dimensions of a foot. The inventive device includes an integrally-formed unitary base which has first and second sections. The first and second sections each have proximal ends and distal ends and top and bottom surfaces. The first and second sections are connected by a living-hinge interconnection portion at their proximal ends. The inventive device also includes a measuring scale attached to the top surfaces of the first and second sections. The foot measurement apparatus includes an erectable heel-tab structure which is attached to the unitary base near the distal end of the first section. The heel-tab structure has a heel-contact portion which is pivotable between a collapsed position, which overlies the top surface of the first section, and an erected position which is substantially normal to the first section.

In certain preferred embodiments, the living-hinge interconnection portion includes a non-hinging middle portion with opposite edges. A living hinge extends from each of the opposite edges to join a respective one of the first and second sections at its proximal end, such that the living-hinge interconnection portion makes the unitary base collapsible. It is most preferred that the first and second sections are substantially similar in length.

Highly desirable is where the heel-tab structure also includes a heel-support portion which is attached to the heel-contact portion and a cross-member which is configured for attachment of the heel-tab structure to the distal end of the first section. Preferably, the heel-tab structure is an integrally-formed piece. Preferred embodiments include the heel-contact portion and a first end of the heel-support portion being interconnected by a living hinge and the heel-contact portion and cross-member are also interconnected by a living hinge.

In highly preferred embodiments, the cross-member on the heel-tab structure spans the width of the first section and includes end members at either end thereof which are dimensioned to snap onto the first section. It is preferred that the heel-support portion is slideably connected at a second end thereof to the cross-member, and preferably, the second end of the heel-support portion includes a lateral stud. In preferred embodiments, the end members of the cross-member include slideways positioned and arranged to receive the lateral studs, whereby the heel-support portion is adjustably secured to the cross-member.

It is most preferred that the foot measurement apparatus further comprises a toe-tab structure which is slideably engaged with the unitary base. The toe-tab structure includes a toe-contact portion and a toe-support portion for attachment to the distal end of the second section.

Preferably, the toe-tab structure is an integrally-formed piece. Preferred embodiments have the toe-contact portion and a first end of the toe-support portion being interconnected by a living hinge and the toe-contact portion and cross-member being interconnected by a living hinge.

In highly preferred embodiments, the cross-member on the toe-tab structure spans the width of the second section and includes end members at either end thereof dimensioned to snap onto the second section. It is preferred that the toe-support portion is slideably connected at a second end thereof to the cross-member. Preferably, the second end of the toe-support portion includes a lateral stud. In preferred embodiments, the end members of the cross-member on the toe-tab structure include slideways positioned and arranged to receive the lateral studs, whereby the toe-support portion is adjustably secured to the cross-member. The end members of the cross-member on the toe-tab structure include tracks enabling the toe-tab structure to slide along the length of the first and second sections.

It is most preferred that the unitary base, heel-tab and toe-tab structures are formed of a semi-rigid plastic material. In certain embodiments the bottom surface of the first and second sections has a recess for attaching information such as operating instructions. It is highly preferred that the measuring scale is attached to the top surfaces of the first and second sections. In certain embodiments the measuring scale is integrally molded into the top surfaces of the first and second sections.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

Figure 1:
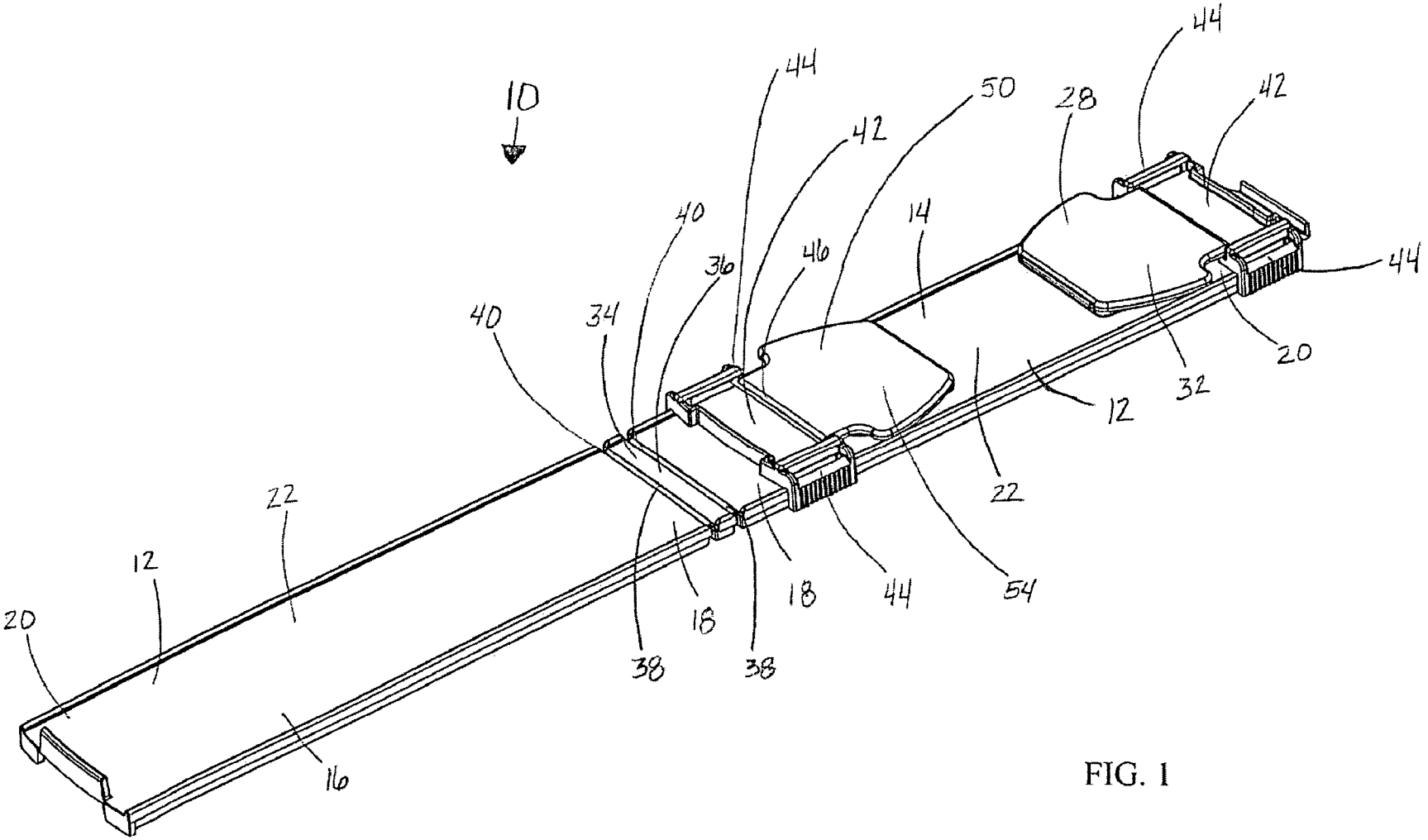
FIG. 1 is a perspective view of a foot measurement apparatus in accordance with this invention.
Figure 14:
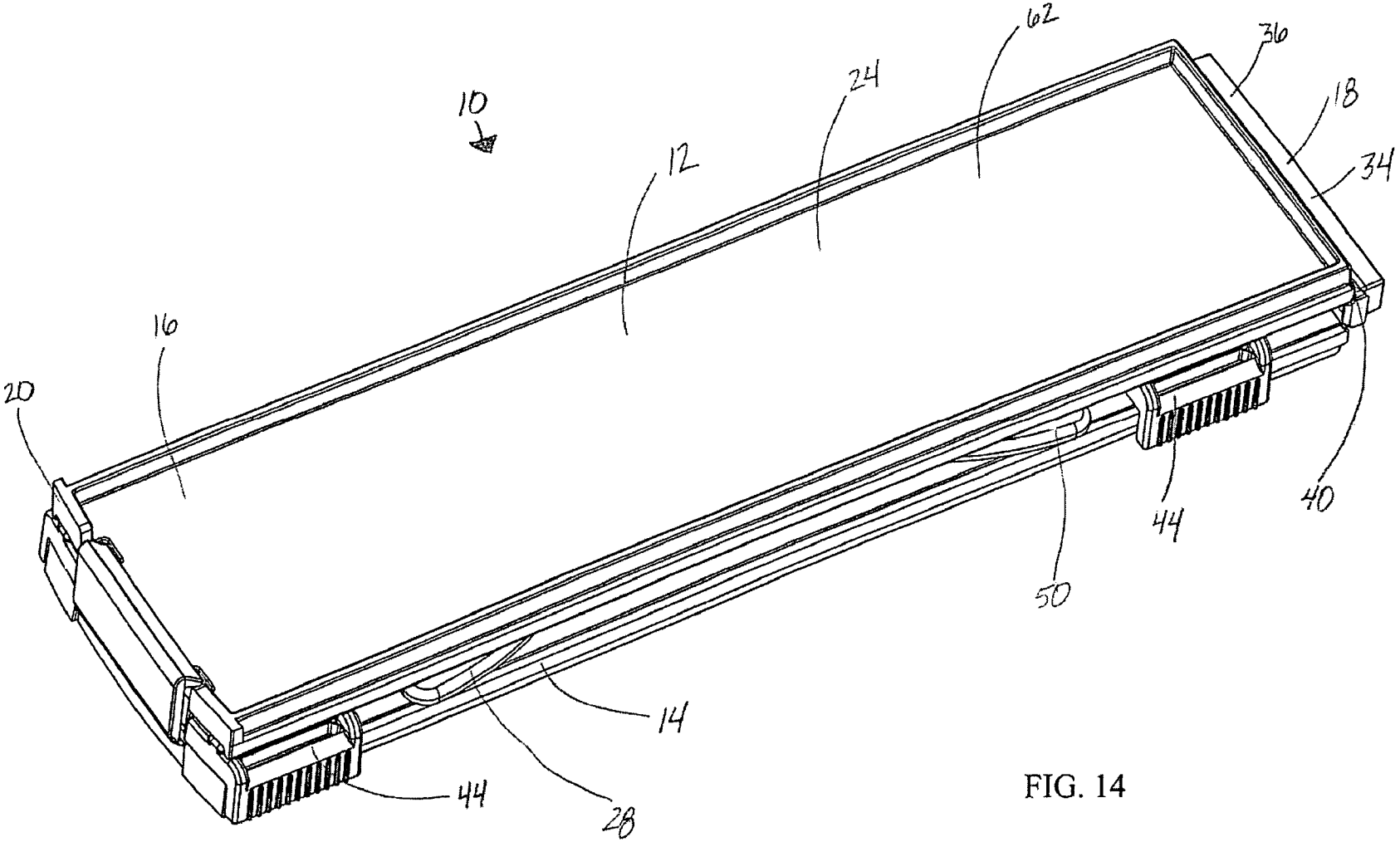
FIG. 14 is a perspective view of the foot measurement apparatus of FIG. 1 in the collapsed position.
Figure 15:
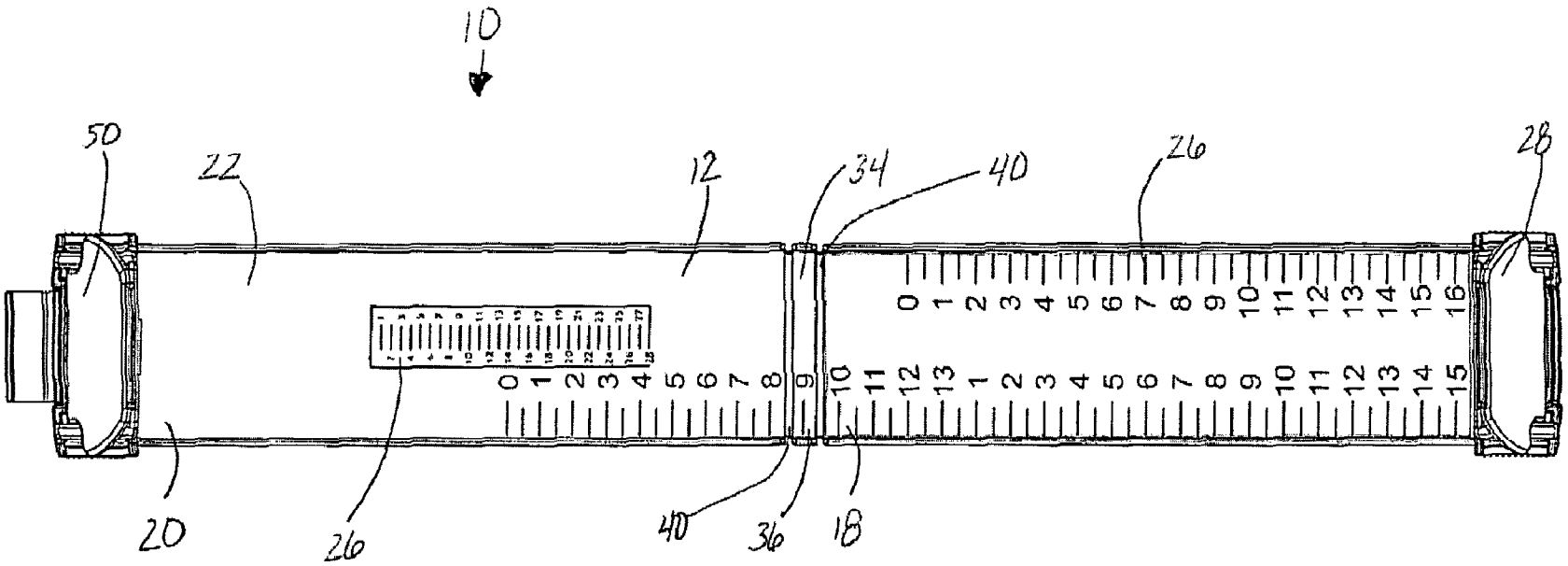
FIG. 15 is a perspective view of the foot measurement apparatus of FIG. 1.

FIGS. 1-17 illustrate a foot measurement apparatus 10 for measuring the dimensions of a foot. The foot measurement apparatus includes an integrally-formed unitary base 12 having first and second sections 14, 16 each with proximal ends 18 and distal ends 20 and top and bottom surfaces 22, 24 as shown in FIG. 1. FIG. 1 illustrates that first and second sections 14, 16 are connected by a living-hinge interconnection portion 34 at their proximal ends 18. First and second sections 14, 16 are substantially similar in length. Foot measurement apparatus also includes measuring scale 26 on the top surfaces 22 of first and second sections 14, 16 as seen in FIG. 15.

An erectable heel-tab structure 28 is attached to unitary base 12 near distal end 20 of first section 14 as seen in FIG. 1. FIGS. 1-7 and 11-14 illustrate that heel-tab structure 28 has a heel-contact portion 30 which is pivotable between a collapsed position overlying top surface 22 of first section 14 and an erected position substantially normal to first section 14.

As shown in FIGS. 2-7 and 11-12, heel-tab structure 28 includes heel-support portion 32 attached to heel-contact portion 30. Cross-member 42 is configured for attachment of heel-tab structure 2S to the distal end 20 of first section 14 as seen in FIGS. 2-7 and 11-12.

Figure 2:
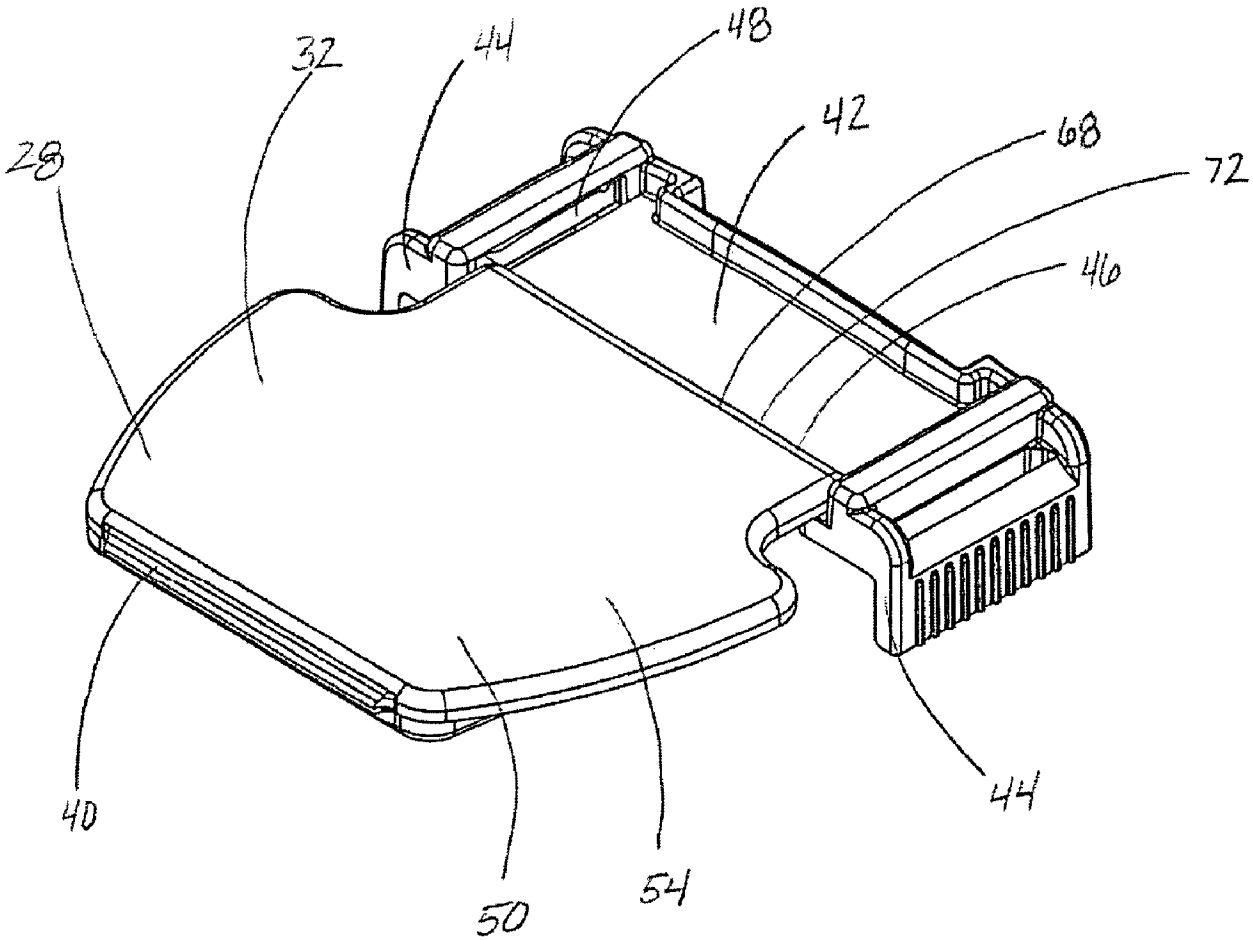
FIG. 2 is a top perspective view of the heel-tab structure or toe-tab structure of the foot measurement apparatus of FIG. 1 in the collapsed position.
Figure 11:
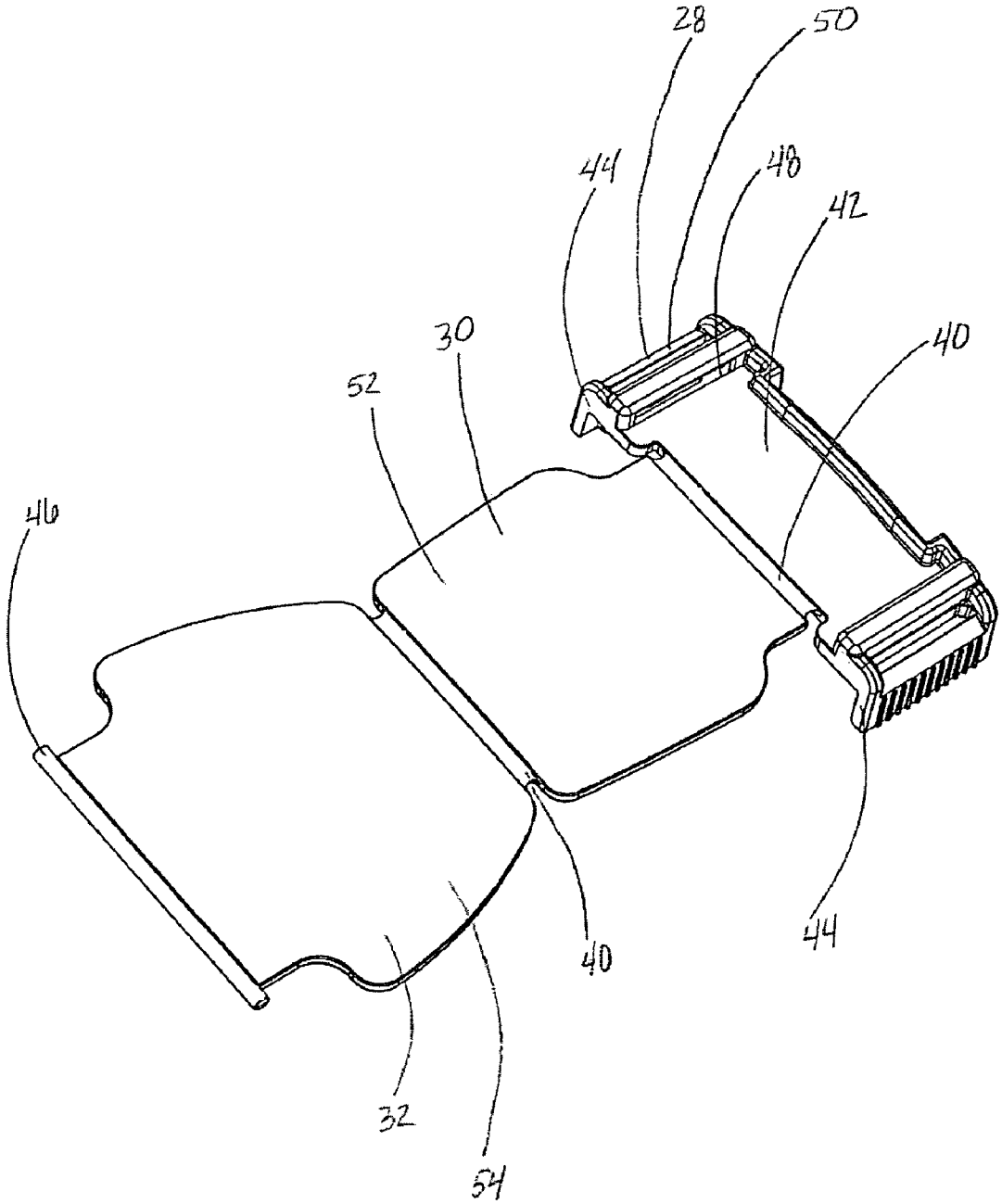
FIG. 11 is a top perspective view of the heel-tab structure or toe-tab structure of the foot measurement apparatus of FIG. 1 in the collapsed position.
Figure 12:
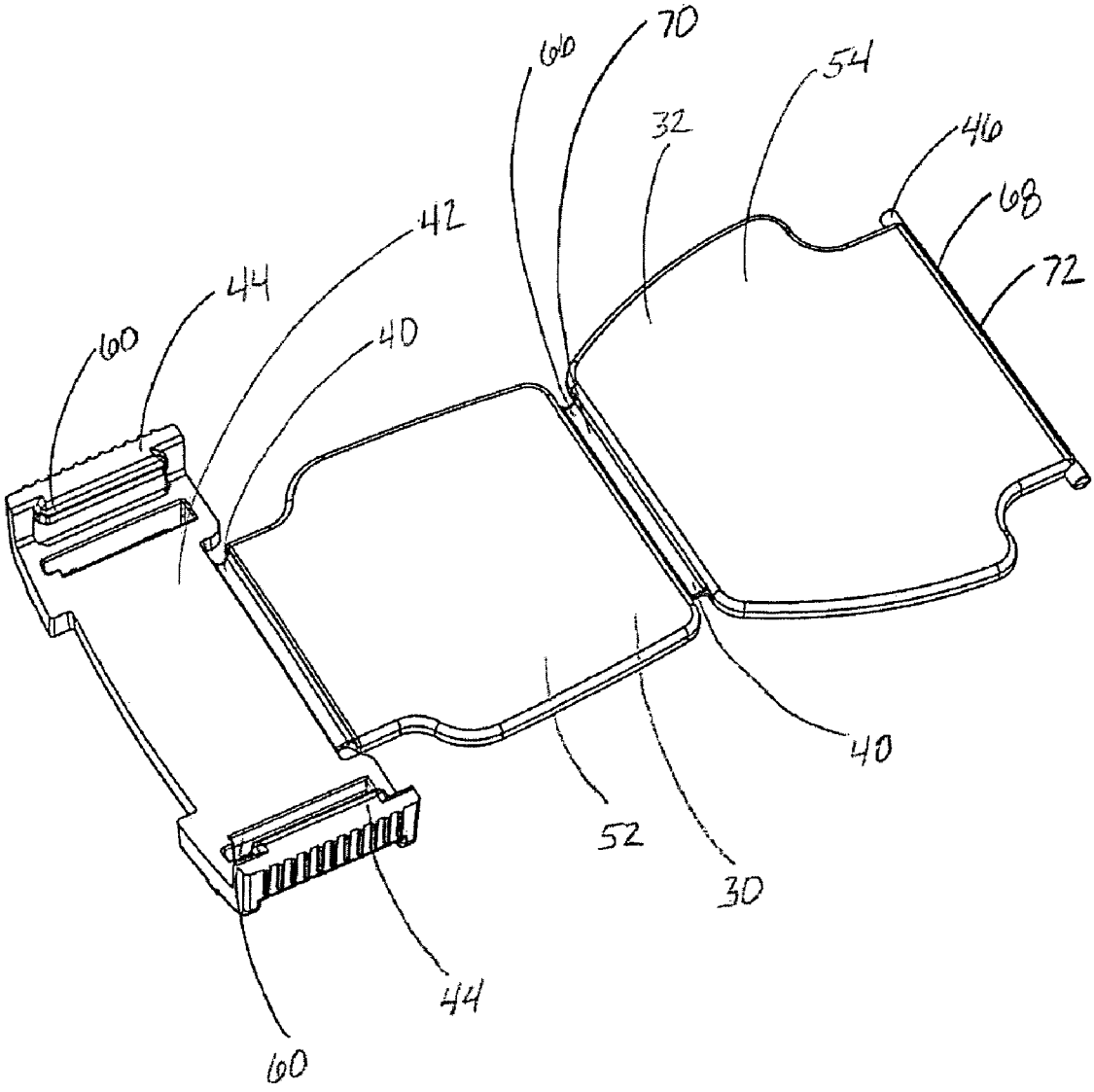
FIG. 12 is a bottom perspective view of the heel-tab structure or toe-tab structure of the foot measurement apparatus of FIG. 1 in the collapsed position.

Heel-tab structure 28 is an integrally-formed piece. Heel-contact portion 30 and a first end 66 of heel-support portion 32 are interconnected by living hinge 40 as illustrated in FIGS. 11-12. FIGS. 11-12 also illustrate that heel-contact portion 30 and cross-member 42 are interconnected by living hinge 40. Cross-member 42 on heel-tab structure 28 spans the width of first section 14 and includes end members 44 at either end thereof dimensioned to snap onto first section 14 as shown in FIGS. 2-7 and 11-12. Heel-support portion 32 is slideably connected at a second end 68 thereof to cross-member 42 as seen in FIG. 2.

Figure 3:
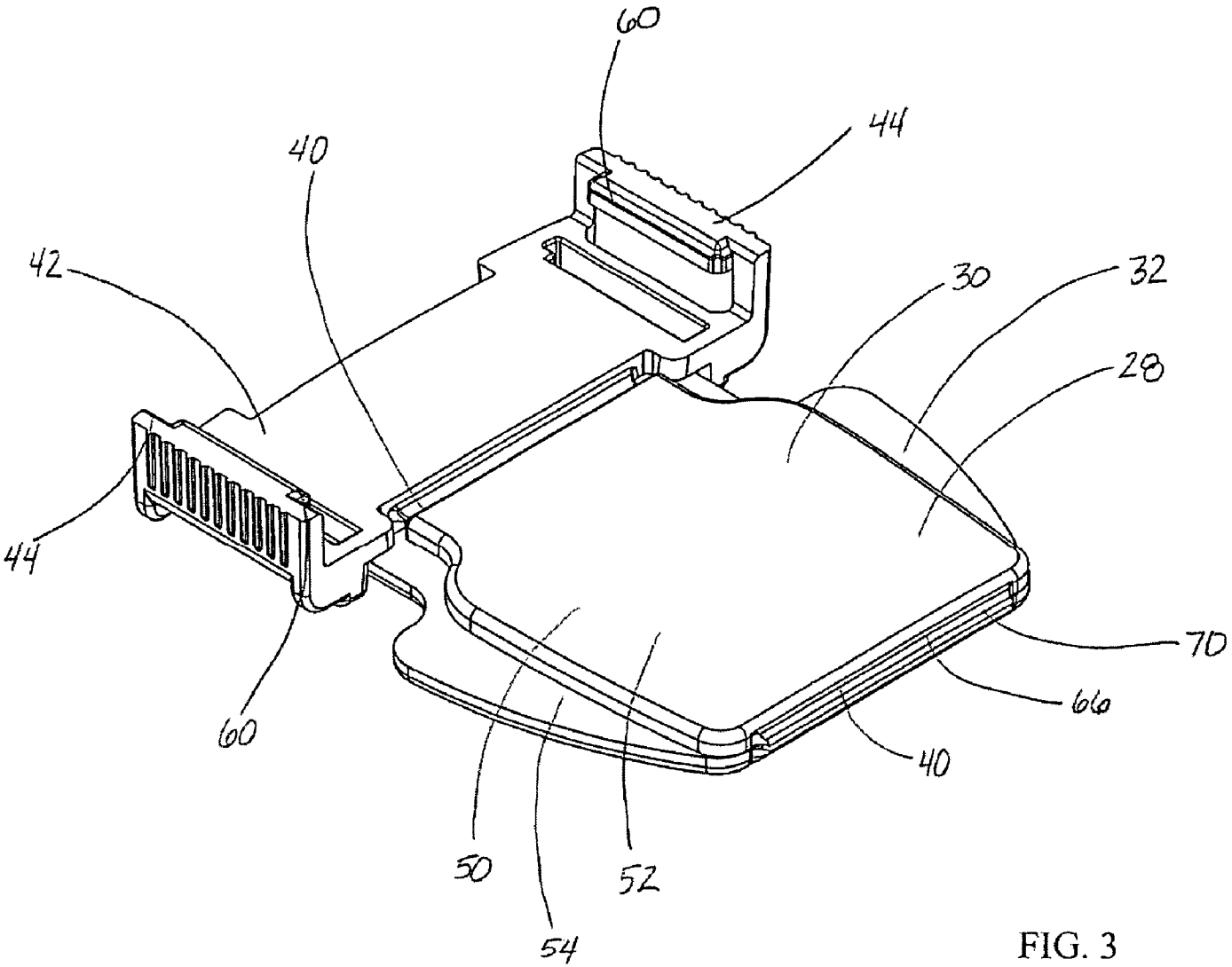
FIG. 3 is a bottom perspective view of the heel-tab structure or toe-tab structure of the foot measurement apparatus of FIG. 1 in the collapsed position.
Figure 4:
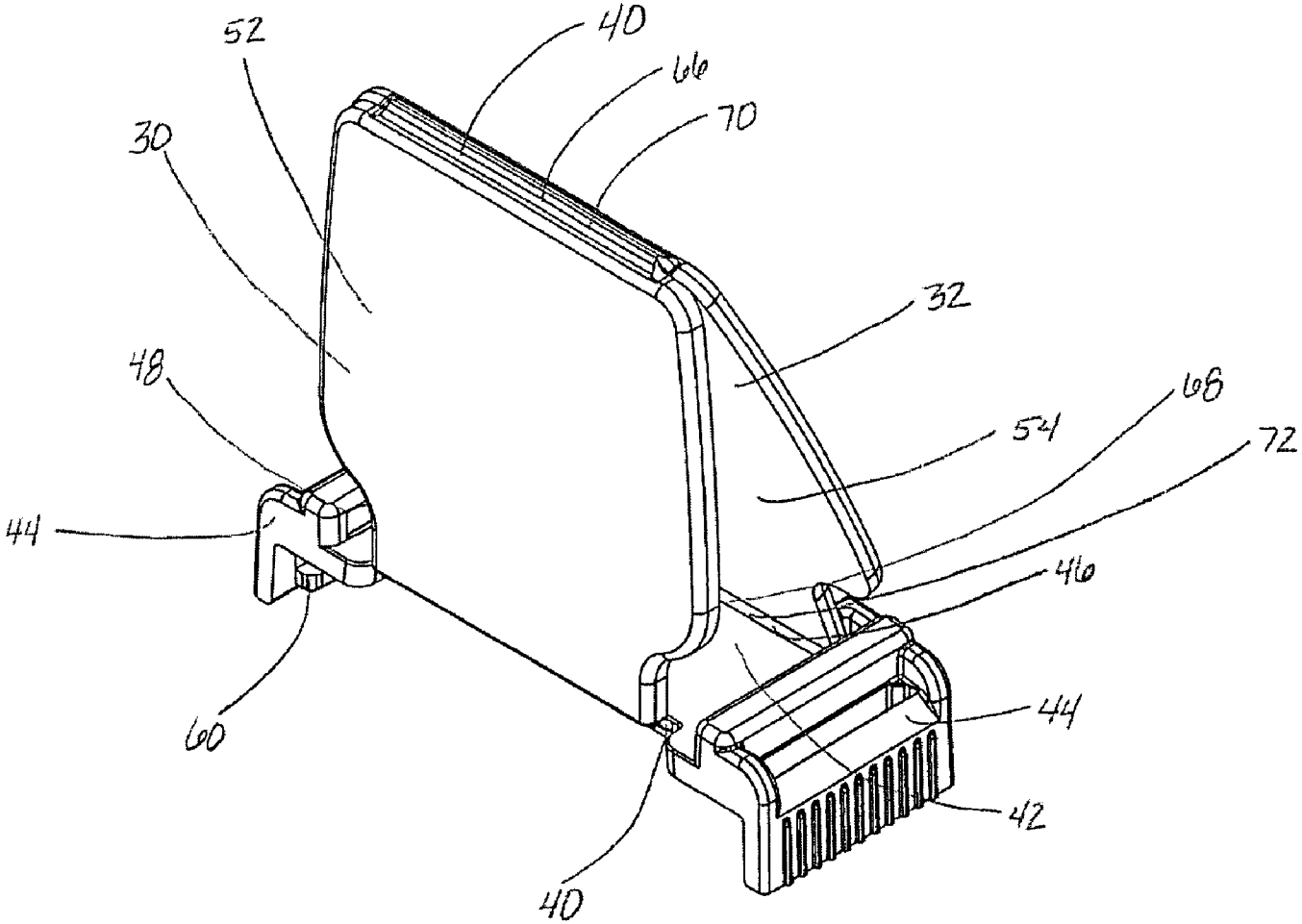
FIG. 4 is a top perspective view of the heel-tab structure or toe-tab structure of the foot measurement apparatus of FIG. 1 in the erected position.
Figure 5:
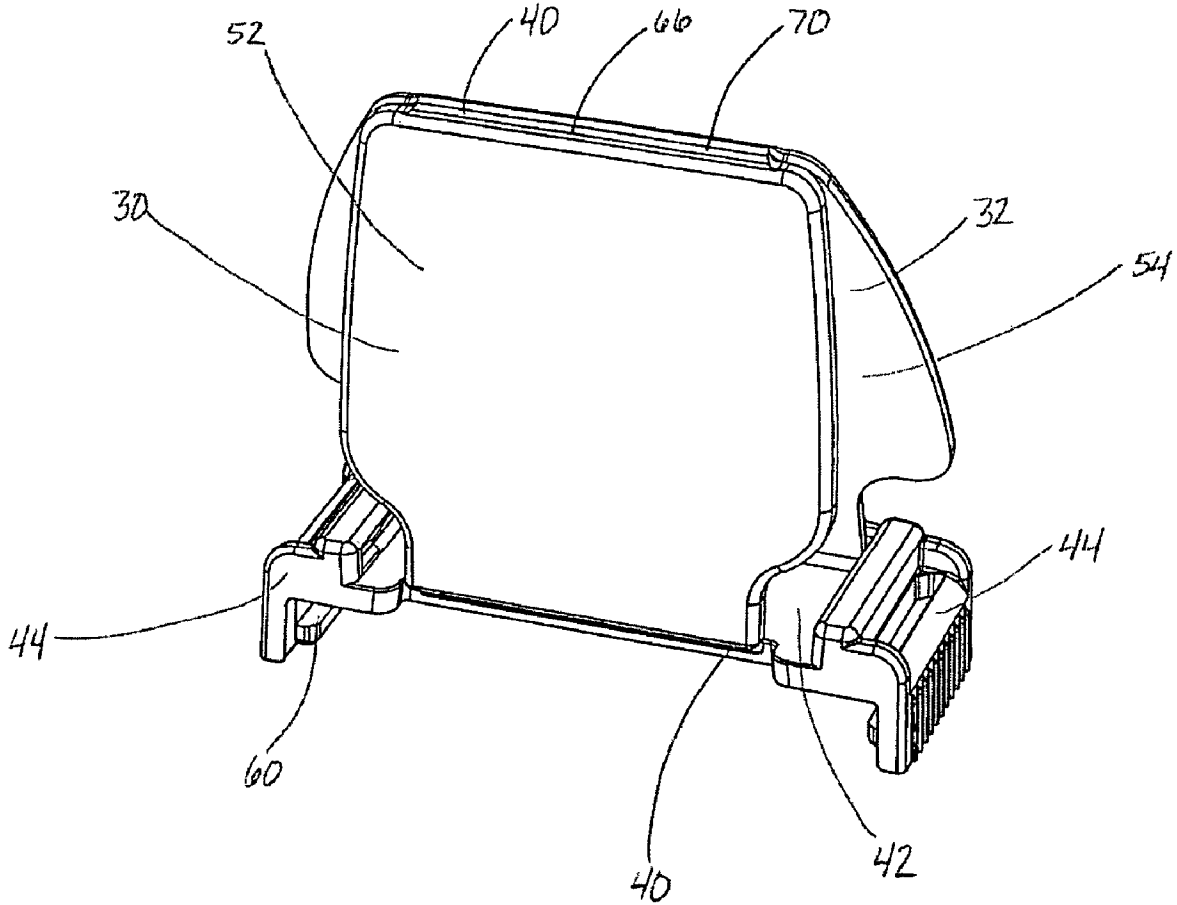
FIG. 5 is a top perspective view of the heel-tab structure or toe-tab structure of the foot measurement apparatus of FIG. 1 in the erected position.
Figure 6:
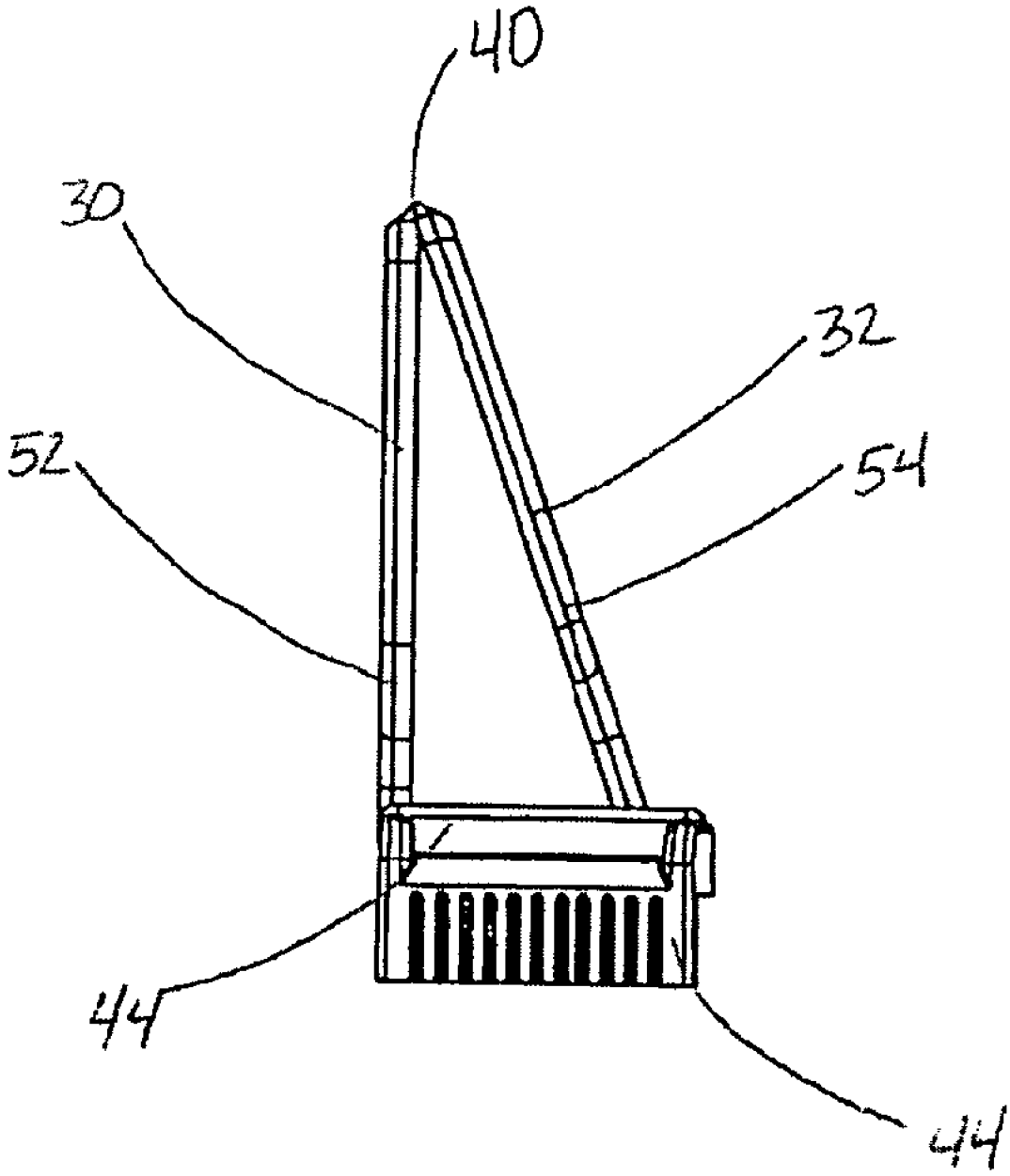
FIG. 6 is a side view of the heel-tab structure or toe-tab structure of the foot measurement apparatus of FIG. 1 in the erected position.
Figure 7:
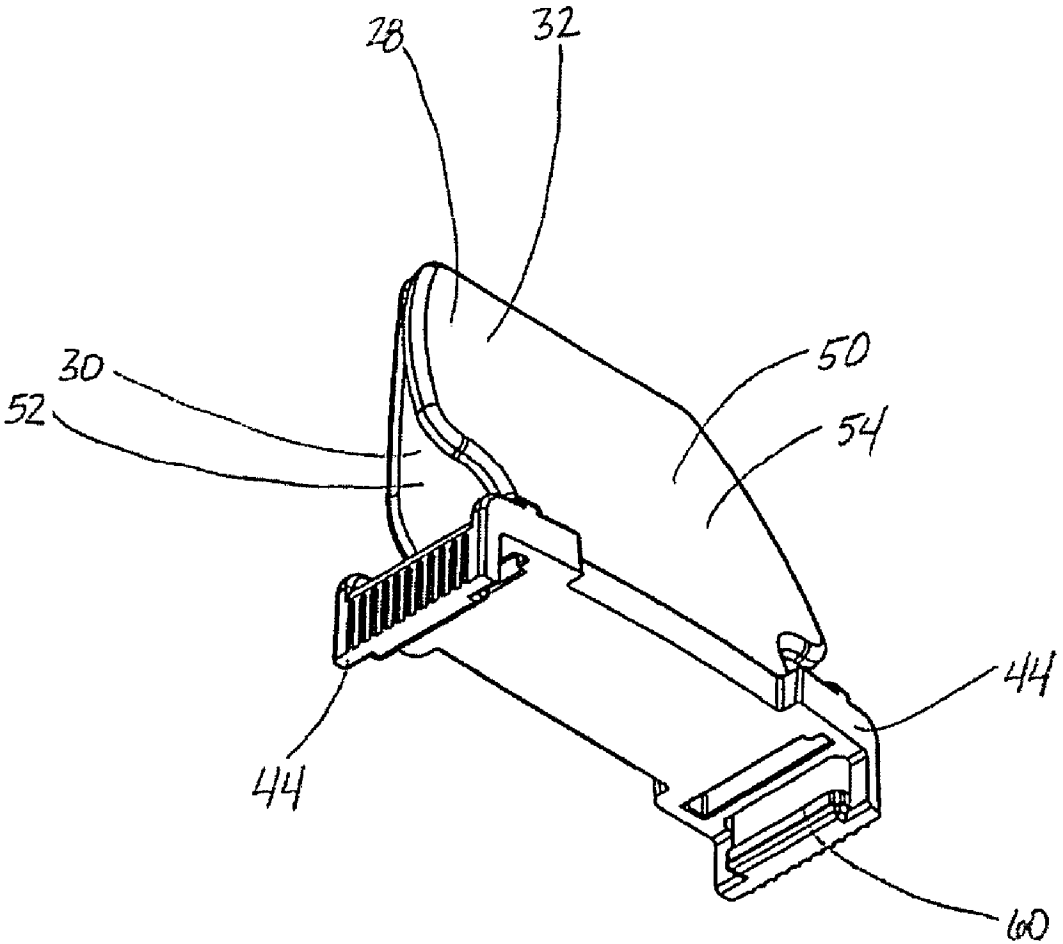
FIG. 7 is a bottom perspective view of the heel-tab structure or toe-tab structure of the foot measurement apparatus of FIG. 1 in the erected position.

Second end 68 of heel-support portion 32 includes lateral stud 46 as illustrated in FIG. 2. End members 44 of cross-member 42 include slideways 48 positioned and arranged to receive lateral stud 46, whereby heel-support portion 32 is adjustably secured to cross-member 42 as shown in FIGS. 2-3. FIGS. 2-3 also illustrate that lateral stud 46 allows heel-support portion 32 to move between a collapsed and erected position by lateral stud 46 moving along the slideways 48.

Fool measurement apparatus 10 also includes a toe-tab structure 50 which is formed in substantially the same configuration as the heel-tab structure 28. Therefore, heel-tab structure 2S and toe-tab structure 50 are shown in the same configuration for identification purposes in FIGS. 2-12. Thus, FIGS. 2-12 will show reference numbers for the parts of the heel-tab structure 28 and the toe-tab structure 50. For example, on FIG. 2, heel-support portion 32 is identified in FIG. 2 as is toe-support portion 54, both, reference numbers 32 and 54 point to the same part since the heel-tab structure 28 and toe-tab structure 50 are configured in the same manner. This will also be the same for other structures which are present in both the heel-tab structure 28 and toe-tab structure 50.

FIGS. 1-7 and 11-12 illustrate that toe-tab structure 50 is slideably engaged with unitary base 12 allowing toe-tab structure 50 to move along the distance of the first and second sections 14, 16. As seen in FIG. 1 toe-tab structure 50 can slide along the first and second sections 14, 16, as toe-tab structure is illustrated in FIG. 1 on the first section 14. Heel-tab structure 28 can also slide along the first and second sections 14, 16; however, heel-tab structure 28 usually remains relatively fixed to the distal end 20 of the first section 14.

Toe-tab structure 50 includes toe-contact portion 52 and toe-support portion 54 for attachment to distal end 20 of second section 16 as seen in FIGS. 4-7 and 11-12. Toe-tab structure 50, like heel-tab structure 28, is an integrally-formed piece. Toe-contact portion 52 and a first end 70 of toe-support portion 54 are interconnected by living hinge 40 as shown in FIGS. 11-12. Toe-contact portion 52 and cross-member 42 are also interconnected by a living hinge 40 as illustrated in FIGS. 11-12.

Cross-member 42 on toe-tab structure 50 spans the width of second section 16 and includes end members 44 at either end thereof dimensioned to snap onto second section 16 as illustrated in FIGS. 2-3 and 11-12. Toe-support portion 54 is slideably connected at a second end 72 thereof to cross-member 42 as shown in FIG. 2.

As with heel-support portion 32, second end 72 of toe-support portion 54 includes a lateral stud 46 as seen in FIG. 2. End members 44 of cross-member 42 on toe-tab structure 50 include slideways 48 positioned and arranged to receive lateral stud 46, whereby toe-support portion 54 is adjustably secured to cross-member 42 as illustrated in FIGS. 2-3.

On toe-tab structure 50, end members 44 of cross-member 42 include tracks 60 enabling toe-tab structure 50 to slide along the length of first and second sections 14, 16 as illustrated in FIGS. 2-3. This allows toe-tab structure 50 to slide from distal end 20 on second section 16 to distal end 20 on first section 14. This also allows toe-tab structure 50 to slide along the length of first and second sections 14, 16 until toe-tab structure 50 abuts heel-tab structure 28.

Figure 13:
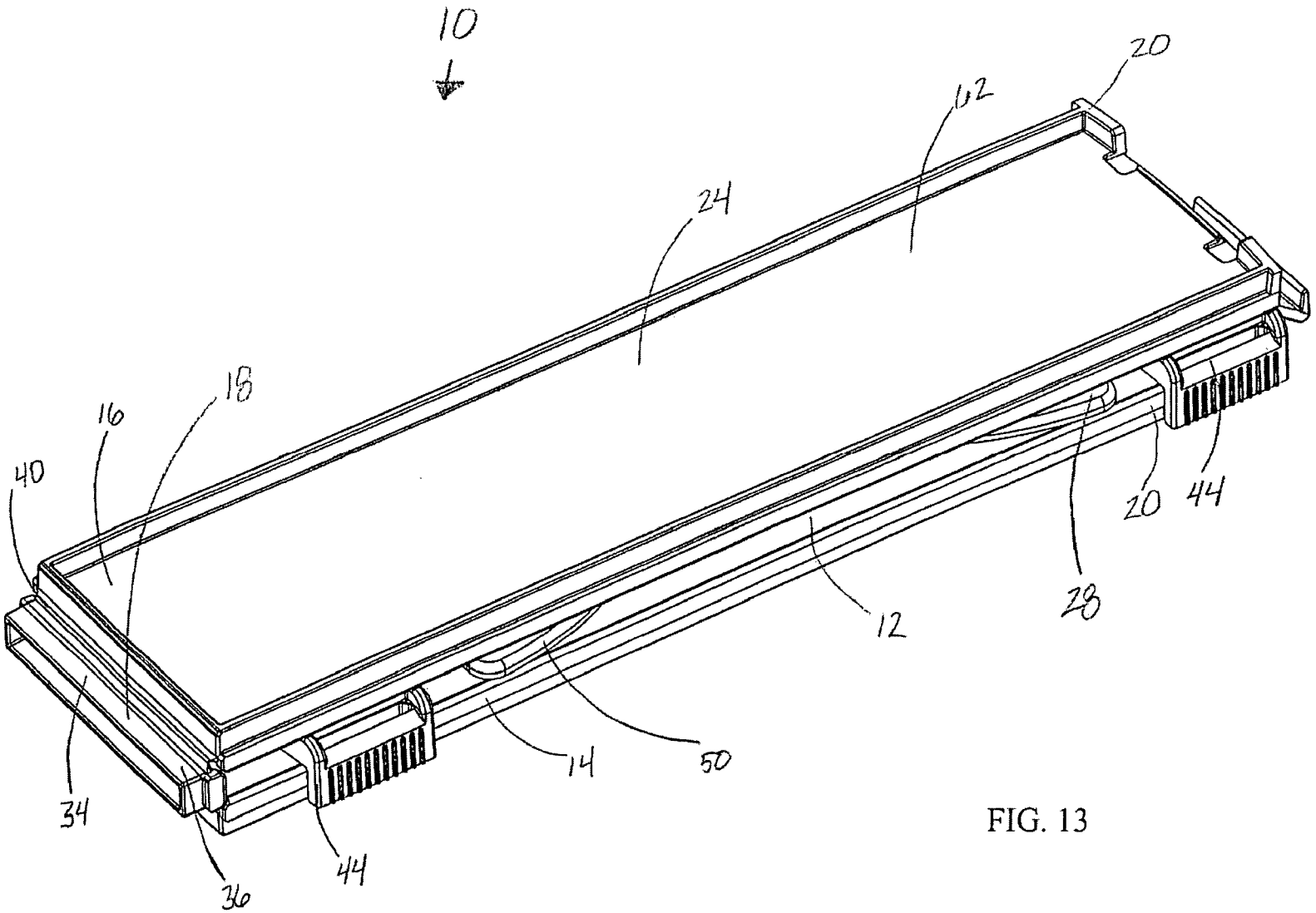
FIG. 13 is a perspective view of the foot measurement apparatus of FIG. 1 in the collapsed position.

FIG. 1 illustrates that living-hinge interconnection portion 34 includes a non-hinging middle portion 36 with opposite edges 38. A living hinge 40 extends from each of the opposite edges 38 to join a respective one of the first and second sections 14, 16 at its proximal end 18, such that living-hinge interconnection portion 34 makes unitary base 12 collapsible as seen in FIGS. 1 and 13-14.

Figure 16:
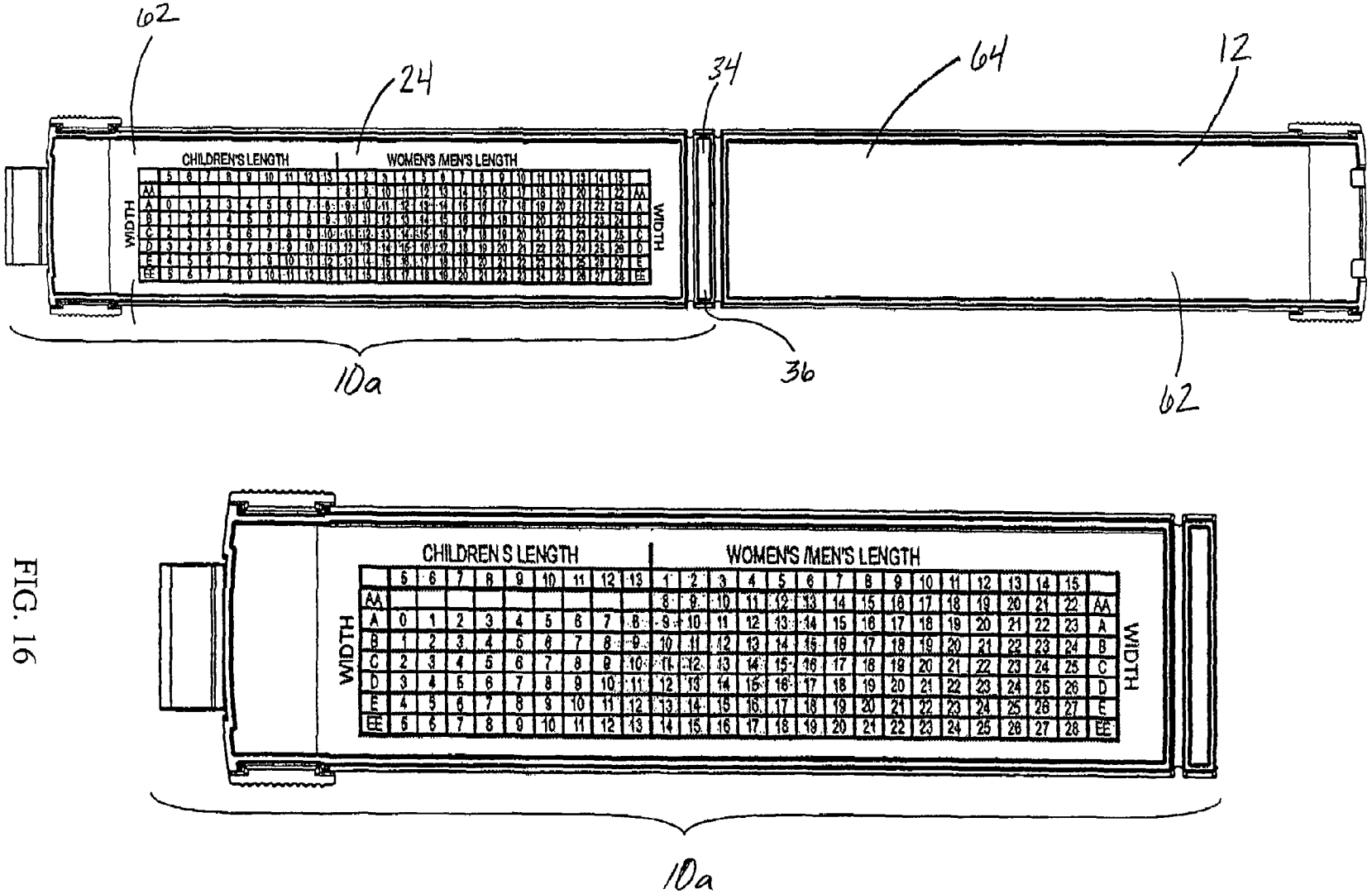
FIG. 16 is a bottom perspective view of the foot measurement apparatus of FIG. 1, FIG. 16 also includes an enlarged perspective view of a portion of the unitary base including the measuring scale.

Bottom surface 24 of first and second sections 14, 16 has a recess 62 for attaching information such as operating instructions 64 as shown in FIG. 16. FIG. 15 illustrates that measuring scale 26 is attached to top surfaces 22 of first and second sections 14, 16. Measuring scale 26 can also be integrally molded into top surfaces 22 of first and second sections 14, 16. Measuring scale 26 is a standard shoe size scale which is utilized in the footwear industry for determining the correct foot size for a pair of shoes. Measuring scale 26 includes a shoe size chart for women, men and children's shoe sizes.

Measuring scale 26 and/or operating instructions 64 are preferably printed on paper with an adhesive backing so that they can be attached to unitary base 12. In FIG. 16 an enlarged view of measuring scale 26 is shown in bracket 10*a*. Instructions 64 can be molded into or attached to the unitary base 12 in the position as indicated by reference number 64 as shown in FIG. 16. Measuring scale 26 and operating instructions 64 can also be molded into unitary base 12 as seen in FIG. 15. Upon receipt of foot measuring apparatus 10 a customer can assemble foot measuring apparatus 10 so that it is in the erected position for use.

Unitary base 12, heel-tab and toe-tab structures 28, 50 are preferably formed of polypropylene or a semi-rigid plastic material. A wide variety of materials are available for the foot measurement apparatus as discussed and illustrated herein.

A user can determine the correct shoe size by utilizing foot measurement apparatus 10. The user places their foot on unitary base 12, which is substantially planar, so that the users heel contacts the heel-contact portion 30 of heel-tab structure 28. Toe-tab structure 50 is then slid across the unitary base 12 until toe-contact portion 52 of toe-tab structure 50 contacts the tip of the users toes. A foot size measurement can then be determined by referencing the position of toe-contact portion 52 in relation to measuring scale 26.

Figure 8:
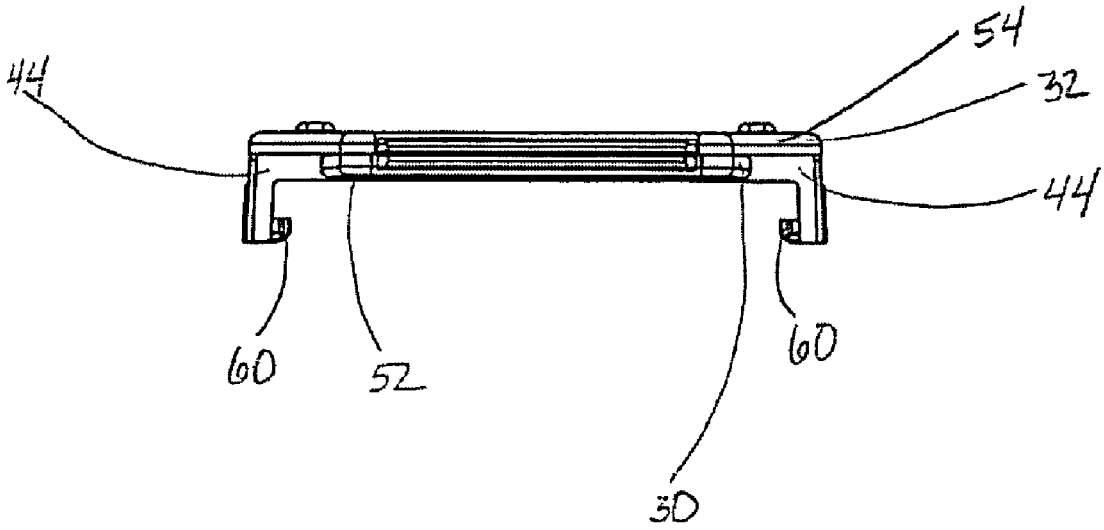
FIG. 8 is a front view of the heel-tab structure or toe-tab structure of the foot measurement apparatus of FIG. 1 in the collapsed position.
Figure 9:
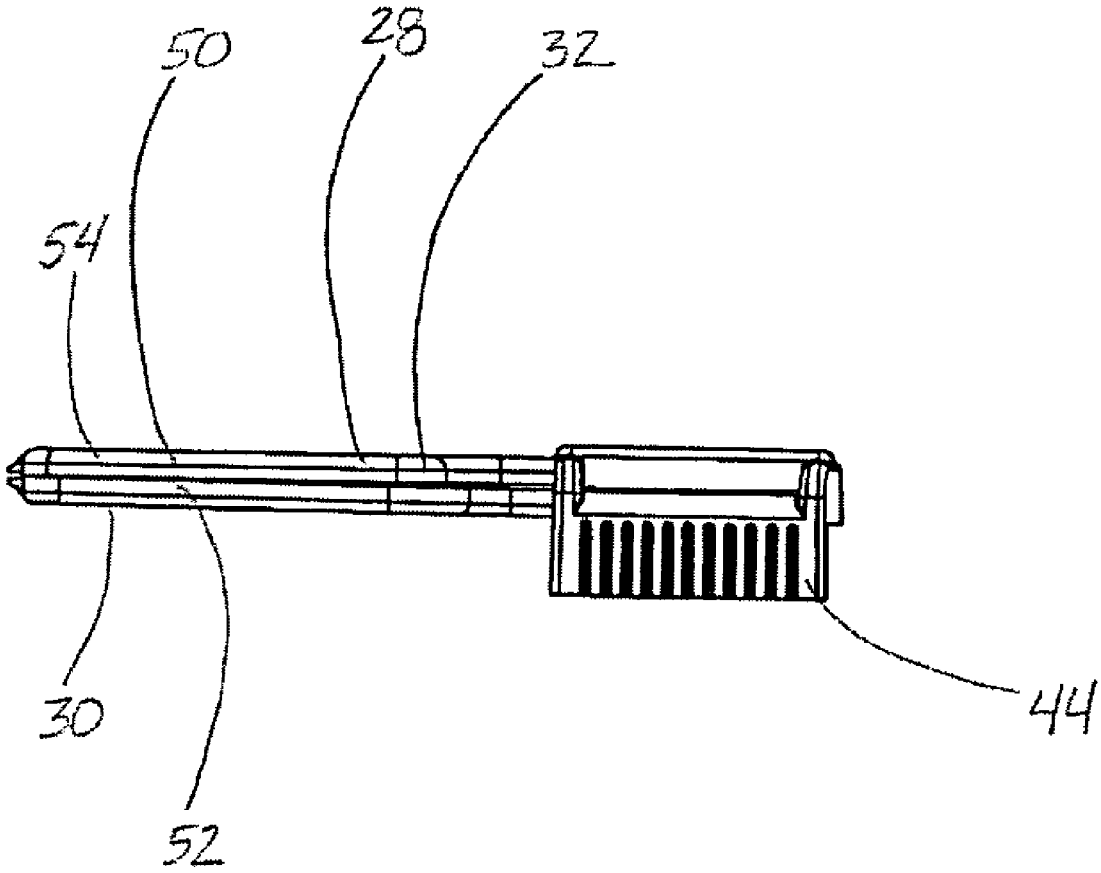
FIG. 9 is a side view of the heel-tab structure or toe-tab structure of the foot measurement apparatus of FIG. 1 in the collapsed position.
Figure 10:
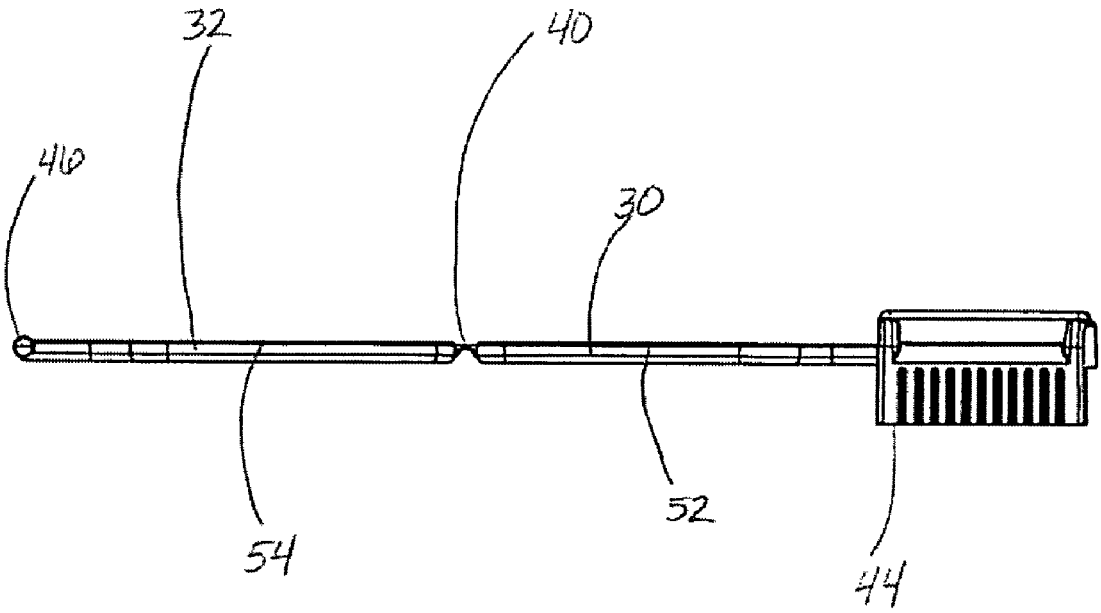
FIG. 10 is a side view of the heel-tab structure or toe-tab structure of the foot measurement apparatus of FIG. 1 in the collapsed position.

Foot measurement apparatus 10 is able to be collapsed so as to enable convenient and compact shipping to customers as seen in FIGS. 13-14. FIGS. 8-10 illustrate heel-tab structure 28 or toe-tab structure 50 in the collapsed position. Erectable heel-tab structure 28 and toe-tab structure 50 can be removed from first and second sections 14, 16 for shipping and/or storage. Erectable heel-tab structure 28 and toe-tab structure 50 can also be collapsed, but not detached, from first and second sections 14, 16 for shipping and/or storage as illustrated in FIGS. 13-14.

FIGS. 13-14 illustrate that once heel-tab and toe-tab structures 28, 50 are removed and/or collapsed unitary base 12 can be folded in half at living hinge 40 located between first section 14 and second section 16 for storage and/or shipping. Operating and instruction manuals 64 can be stored in recess 62 of bottom surface 24 of first and second sections 14, 16 as seen in FIG. 16. Foot measurement apparatus 10 usually shipped to customers in the collapsed position as it is generally compact. Upon receipt of foot measurement apparatus 10 by customer measuring scale 26 will be already attached to top surface 22 of first and second sections 14, 16 so measuring scale 26 does not require assembly by customer.

Figure 17:
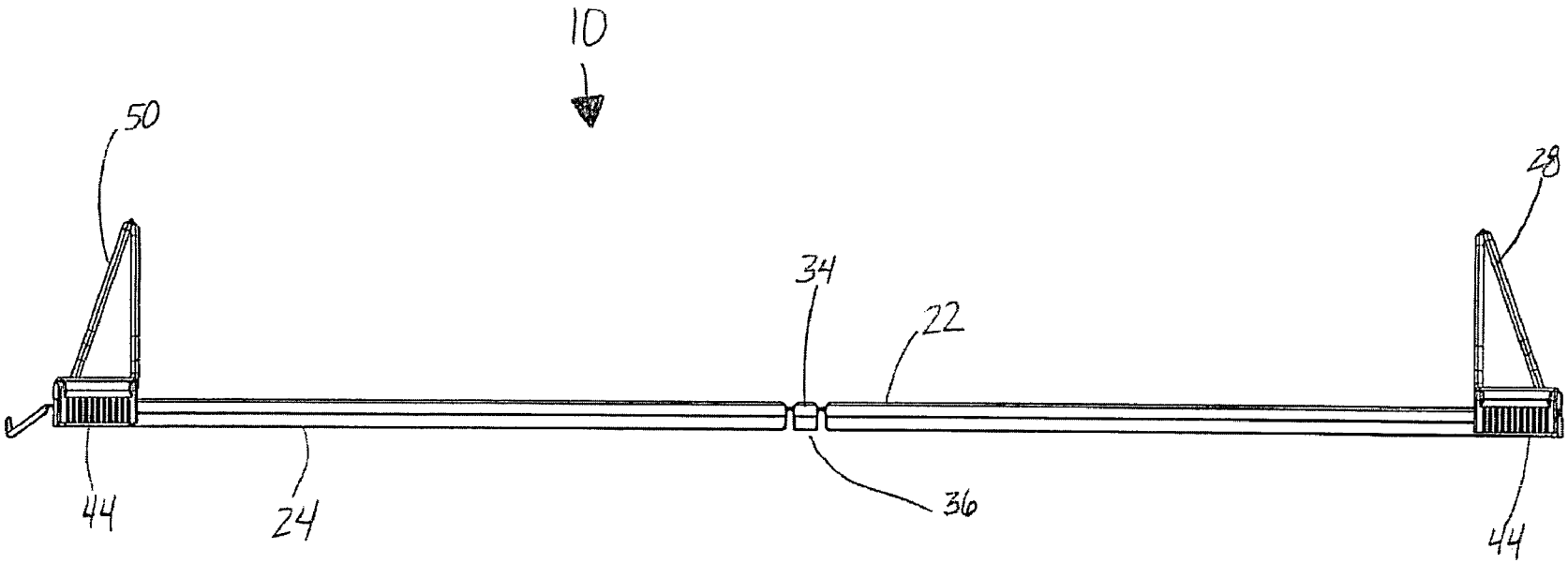
FIG. 17 is a side view of the foot measurement apparatus device of FIG. 1

Upon receipt customer can assemble foot measurement apparatus 10 by taking unitary base 10 and elongating it by unfolding unitary base 10 through the use of living hinge 40 located between first and second sections 14, 16 so that foot measurement apparatus 10 is in the erected position as illustrated in FIGS. 1 and 15-17. Next customer can attach heel-tab structure 28 to distal end 20 of first section 14 through the use of cross-member 42. Heel-tab structure 28 will snap into place on unitary base 10. The same steps are taken to erect toe-tab structure 50 on distal end 20 of second section 16. Toe-tab structure 50 is attached by cross-member 42 to distal end 20 of second section 16. Toe-tab structure 50 will snap into place on unitary base 10. FIG. 15 is a top view of the foot measurement apparatus in the erected position, while FIG. 16 is a bottom view. FIG. 17 is a side view of the foot measurement apparatus 10 in the erected position.

While the principles of this device have been described in connection with specific embodiments, it should be understood clearly that these descriptions are made only by way of example and are not intended to limit the scope of the invention.

The invention claimed is:

1. A foot measurement apparatus for measuring the dimensions of a foot, including (a) an integrally-formed unitary base having first and second sections each with proximal ends and distal ends and top and bottom surfaces, the first and second sections being connected by a living-hinge interconnection portion at their proximal ends, the living-hinge interconnection portion includes a non-hinging middle portion with opposite edges, a living hinge extending from each of the opposite edges to join a respective one of the first and second sections at its proximal end, such that the living-hinge interconnection portion makes the unitary base collapsible, (b) a measuring scale on the top surfaces of the first and second sections, (c) an erectable heel-tab structure attached to the unitary base near the distal end of the first section, the heel-tab structure having a heel-contact portion pivotal between a collapsed position overlying the top surface of the first section and an erected position substantially normal to the first section, the heel-tab structure being removable from the unitary base, and (d) a toe-tab structure slideably engaged with the unitary base and including a toe-contact portion and a toe-support portion for attachment to the distal end of the second section.

2. The foot measurement apparatus of claim 1 wherein:

the first and second sections are substantially similar in length.

3. The foot measurement apparatus of claim 1 wherein the heel-tab structure further includes:

a heel-support portion attached to the heel-contact portion; and a cross-member configured for attachment of the heel-tab structure to the distal end of the first section.

4. The foot measurement apparatus of claim 3 wherein;

the heel-tab structure is an integrally-formed piece; and the heel-contact portion and a first end of the heel-support portion are interconnected by a living hinge and the heel-contact portion and cross-member are interconnected by a living hinge.

5. The foot measurement apparatus of claim 4 wherein:

the cross-member spans the width of the first section and includes end members at either end thereof dimensioned to snap onto the first section; and the heel-support portion is slideably connected at a second end thereof to the cross-member.

6. The foot measurement apparatus of claim 5 wherein:

the second end of the heel-support portion includes a lateral stud; and the end members of the cross-member include slideways positioned and arranged to receive the lateral stud, whereby the heel-support portion is adjustably secured to the cross-member.

7. The foot measurement apparatus of claim 3 wherein:

the toe-tab structure is an integrally-formed piece; and the toe-contact portion and a first end of the toe-support portion are interconnected by a living hinge and the toe-contact portion and cross-member are interconnected by a living hinge.

8. The foot measurement apparatus of claim 7 wherein:

the cross-member spans the width of the second section and includes end members at either end thereof dimensioned to snap onto the second section; and the toe-support portion is slideably connected at a second end thereof to the cross-member.

9. The foot measurement apparatus of claim 8 wherein:

the second end of the toe-support portion includes a lateral stud; and the end members of the cross-member include slideways positioned and arranged to receive the lateral studs, whereby the toe-support portion is adjustably secured to the cross-member.

10. The foot measurement apparatus of claim 9 wherein the end members of the cross-member include tracks enabling the toe-tab structure to slide along the length of the first and second sections.

11. The foot measurement apparatus of claim 1 wherein the unitary base, heel-tab and toe-tab structures are formed of a semi-rigid plastic material.

12. The foot measurement apparatus of claim 1 wherein the bottom surface of the first and second sections has a recess for attaching information such as operating instructions.

13. The foot measurement apparatus of claim 1 wherein the measuring scale is attached to the top surfaces of the first and second sections.

14. The foot measurement apparatus of claim 1 wherein the measuring scale is integrally molded into the top surfaces of the first and second sections.

* * * * *